US007506683B2

(12) United States Patent
Hu

(10) Patent No.: US 7,506,683 B2
(45) Date of Patent: Mar. 24, 2009

(54) MULTI-TYPE FINS FOR MULTI-EXCHANGERS

(75) Inventor: Zaiqian Hu, Carmel, IN (US)

(73) Assignee: Valeo, Inc., Auburn Hills, MI (US)

( * ) Notice: Subject to any disclaimer, the term of this patent is extended or adjusted under 35 U.S.C. 154(b) by 0 days.

(21) Appl. No.: 10/851,392

(22) Filed: May 21, 2004

(65) Prior Publication Data

US 2005/0257921 A1 Nov. 24, 2005

(51) Int. Cl.
*F28D 7/10* (2006.01)
*F28D 7/06* (2006.01)
*F28D 1/04* (2006.01)

(52) U.S. Cl. ..... 165/140; 165/176; 165/151

(58) Field of Classification Search ..... 165/140, 165/172, 175, 176, 179, 153, 916, 143–144, 165/151

See application file for complete search history.

(56) References Cited

U.S. PATENT DOCUMENTS

| | | | | | |
|---|---|---|---|---|---|
| 2,505,790 | A * | 5/1950 | Panthofer | 165/140 |
| 5,076,354 | A * | 12/1991 | Nishishita | 165/146 |
| 5,101,890 | A * | 4/1992 | Aoki et al. | 165/152 |
| RE35,742 | E * | 3/1998 | Hoshino et al. | 165/150 |
| 5,743,328 | A * | 4/1998 | Sasaki et al. | 165/144 |
| 6,021,846 | A * | 2/2000 | Sasaki et al. | 165/144 |
| 6,394,176 | B1 * | 5/2002 | Marsais | 165/140 |
| 6,672,376 | B2 | 1/2004 | Shembekar et al. | |
| 6,739,386 | B2 * | 5/2004 | Lamich et al. | 165/175 |
| 6,789,613 | B1 * | 9/2004 | Ozaki et al. | 165/140 |
| 6,793,012 | B2 * | 9/2004 | Fang et al. | 165/140 |
| 7,096,932 | B2 * | 8/2006 | Scoville et al. | 165/140 |
| 2004/0069446 | A1 * | 4/2004 | Horiuchi | 165/43 |
| 2004/0216863 | A1 * | 11/2004 | Hu | 165/110 |

FOREIGN PATENT DOCUMENTS

| | | | |
|---|---|---|---|
| DE | 19813069 | A1 | 9/1999 |
| FR | 2682160 | A | 4/1993 |
| JP | 2001 174190 | | 6/2001 |
| JP | 2003 021432 | | 1/2003 |
| WO | WO03/095918 | | 11/2003 |
| WO | WO03/106910 | | 12/2003 |
| WO | WO2004/099695 | | 11/2004 |
| WO | WO2005/003669 | | 1/2005 |

OTHER PUBLICATIONS

U.S. Appl. No. 10/425,348, Hu.
U.S. Appl. No. 10/603,082, Hu.

* cited by examiner

*Primary Examiner*—Tho V Duong
(74) *Attorney, Agent, or Firm*—Dierker & Associates, P.C.

(57) ABSTRACT

Optimized designs of heat exchangers, and, in particular, heat exchangers and assemblies comprising multi-exchangers or combo coolers comprising different heat exchanger parts or elements, and fins or separators of different types and/or characteristics on the different tube parts of the heat exchanger results, are disclosed. The two part heat exchanger is capable of being traversed by different fluids, and fins differ in characteristics, such as height and pitch, to increase overall heat exchanger efficiency.

9 Claims, 7 Drawing Sheets

MULTI-TYPE FINS FOR MULTI-EXCHANGERS

FIELD OF THE INVENTION

The invention relates to the field of multi-exchangers such as combo cooler heat exchangers, for automotive vehicles, having a bank of spaced fluid conduits or tubes capable of being traversed by different fluids and fins of varying structure.

BACKGROUND OF THE INVENTION

Traditionally, engine oils (transmission oil, power steering oil, etc) are cooled by oil coolers. These oil coolers are located either within the water tank of a radiator (called "water-cooled in-tank" oil cooler) or in front of condensers (air-cooled oil cooler). In some cases, when the thermal cooling requirement is high, either in-tank water-cooled oil cooler or air-cooled oil cooler cannot satisfy the increased cooling requirement, and two separate oil coolers must be used.

The traditional oil cooler layout has several advantages: the in-tank oil cooler has good cold start in the winter, as oil is warmed by water inside radiator. Air-cooled oil coolers have flexibility of location. The disadvantages of a separate air-cooler are decreased by employing an air-cooled oil-cooler within a combo-cooler, which leads to lower cost, as well as huge packaging savings.

The use of fins in air-cooled type heat exchangers for automobiles is known. Fins reduce the temperature of various working fluids, including engine coolant, engine lubricating oil, air conditioning refrigerant, and automatic transmission fluid, among others. The heat exchanger typically includes a plurality of spaced fluid conduits or tubes connected between an inlet and an outlet, and a plurality of heat exchanging fins interposed between adjacent tubes or conduits. Air is directed across the fins via a cooling fan or the motion of the automobile. As the air flows across the fins, heat in the fluid flowing in the tubes is conducted through the walls of the tubes into the fins and transferred or "exchanged" into the airflow.

In order to achieve high production simplicity to meet ever increasingly heat exchanger thermal requirements, for most heat exchangers, it is preferable that fins or separators are used. The fins or separators may touch or connect similar types of tubes, (i.e. the fins or separators may 'touch' or 'connect' condenser tubes to condenser tube, or oil tube to oil tubes), or different tubes (for example condenser to oil tubes, etc.).

One of the primary goals in heat exchanger design is to achieve the highest possible thermal efficiency. Thermal efficiency is measured by dividing the amount of heat that is actually transferred by the heat exchanger in a given set of conditions (amount of airflow, temperature difference between the air and fluid, etc.) by the theoretical maximum possible heat transfer under those conditions. An increase in the rate of heat transfer, therefore, results in greater thermal efficiency. Heat transfer is also affected by the air pressure drop associated with the change in airflow direction caused by the fins. A greater air pressure drop results in less heat transfer. Various types of fin designs have been disclosed in the prior art with the object of increasing the heat exchanger efficiency by making improvements in the fins and airflow pattern.

One of the advantages of multi-exchanger or combo-coolers is that multiple heat exchangers (multi-exchangers) can be employed which share, for example, the same frontal area or space of a vehicle. Multi-exchanger or combo cooler heat exchangers have two or more heat exchanger parts comprising fluid conduits or tubes wherein different fluids can flow within the different tubes. Combo coolers, therefore, encounter manufacturing difficulties, and, therefore, there has been a need to find solutions to make production of said coolers more uniform, and therefore, increase efficiency of production.

The prior art has shown a fin preference towards using the same types of fins or separators in heat exchangers. Because the whole multi-exchanger can be assembled at the same time, the use of one type of manifold, core and fin leads to a saving in assembling cost (core assembly, brazing), as well as material cost (only one pair of manifold, only one pair of brackets).

Though using the same type of fins for both condenser and oil-cooler can be done for simplicity and ease of production, it is clearly not sufficient or optimal from a product design point for heat exchanger applications. It continues to be desirable to increase overall heat exchanger efficiency. Fin design continues to play an important role in increasing heat exchanger efficiency. In other words, when a 'condenser fin' is optimized, the same fin for oil cooler is not optimized, and vice-versa. It is one of the objectives of the present invention to provide for optimized heat exchanger efficiency in multi-exchangers or combo coolers. By going against the prior art usage of same type fins throughout the heat exchanger in favor of employing different type fins on different parts of the multi-exchanger or combo-cooler, optimization of overall heat exchanger efficiency can be achieved based on the different characteristics of the multi-exchanger.

OBJECT OF THE INVENTION

One objective of the present invention is to optimize the designs of heat exchangers, and, in particular, heat exchangers comprising different heat exchanger parts or elements, wherein the use of different type fins or separators or different parts of the heat exchanger, and, especially, on the multi-exchanger on combo cooler, is achieved to result in a superior overall thermal exchange function. More particularly, it is an object of the invention to provide a heat exchanger comprising at least one multi-exchanger or combo cooler, with fins or separators, with superior overall thermal exchange function while remaining competitive from a cost standpoint. It a further object of the invention to provide for a design of heat exchanger comprising both oil cooler and condenser parts or elements, such as a combo cooler, which, with improved overall thermal exchange properties, and, which, when used in conjunction with other single heat exchangers, such as radiators, provide for both overall thermal exchange and cost benefits. The present invention, therefore, keeps the key advantage of combo-cooler technology (exchangers sharing the same pair of manifolds/brackets, as well as the same core assembling/brazing process) with the advantage of having fins or separators specifically chosen and integrated to optimize the separate exchanger parts as well as the overall function of the multi-exchanger.

SUMMARY OF THE INVENTION

The prevent invention relates to the heat exchangers, and, in particular, multi-exchangers or combo cooler heat exchangers, for automotive vehicles, having a bank of spaced fluid conduits or tubes linked to manifolds, the bank divided into two parts capable of having different fluids flow therethrough, and fins that differ in characteristics, such as height, pitch and/or structure, to increase heat exchanger efficiency. On gross visual examination, heat exchangers such as condensers and oil coolers, may look similar. However, they differ fundamentally in their thermal properties. In particular, oil is much more viscous than refrigerant or gas. In terms of thermal resistance, for example, in a condenser, the refrigerant-side thermal resistance is usually between about 25% to 35% of the total resistance of the condenser, and air-side thermal resistance is usually about between 65% to 75% of the total resistance. However, in a typical oil-cooler, the oil-side thermal resistance is usually between about 55% to 65%, and the air-side thermal resistance is usually between about 35% to 45%. This difference in values for coolant or refrigerant side thermal resistance versus air-side thermal resistances is significant.

The present invention provides an improved heat exchanger having a first end tank or manifold and a second end tank or manifold opposite the first end tank or manifold. One or more first tubes are in fluid communication with the first and second end tanks or 'manifolds' and the one or more first tubes are adapted to have a first fluid flow therethrough. One or more second tubes are also in fluid communication with the first and second end tanks or 'manifolds' and the one or more second tubes are adapted to have the second fluid flow therethrough. Although the first and second tubes may be similar or identical to each other, it is preferable that they be different. In multi-exchanger or combo cooler heat exchangers, there, preferably, is a plurality of tubes or a 'bank' of tubes divided into at least one first part wherein circulates the first fluid, such as oil in an oil cooler, and at least one second part wherein circulates the second fluid, such as a refrigerant in a condenser, and a plurality of heat exchanging fins 'integrated' or 'interposed' between adjacent tubes or conduits such that at least one first type of fin contacts a tube or tubes of the first part of the bank and at least one second type of fin contacts the tube or tubes of the second part of the bank, thereby optimizing the overall thermal exchange capacity of the multi-exchanger.

Many present day heat exchanger designs have fins however, the fins are normally all of the same size or type for commercial reasons. In the European market, for example, a majority of automobiles use manual transmissions (no oil-cooler requirement), and a minority of automobiles use automatic transmissions (therefore requiring oil-cooler type technology). In same type of fin situations using manual transmissions, in order to reduce the condenser cost for the manual transmission vehicle, fin height would be constant and need to be increased (fewer tubes used). However there is a particularly longfelt need for a solution where same type fins solutions are not adequate, as in, for example, automatic transmission vehicles. The industry, therefore, faces a dilemma; having two different standards of tube spacing due to fins and thermal requirements, one for manual transmission vehicles, and another for automatic vehicles, or using a low fin height for both applications. In the first case, because of the low volume for the automatic transmission vehicle, the cost of multi-exchanger such as a combo-cooler will be very high. If the solution of a lower fin height, standard for both cases is used, the solution is less cost-effective for the majority application (utilizing oil cooler and condenser).

The North America market has long faced the same problem in reverse: the majority of vehicles in the market use automatic transmission technology, and the minority of vehicles use manual transmission technology. The present invention finally provides a uniform solution under both such environments, particularly where multi-exchanger or combo-coolers are used, by providing for a more optimal fin, and multi-exchanger assembly arrangement, to provide higher overall heat exchanger efficiency.

BRIEF DESCRIPTION OF THE DRAWINGS

In the description which follows, given by way of example, reference will be made to the attached drawings, in which.

DETAILED DESCRIPTION OF THE PREFERRED EMBODIMENTS

Figure 1:
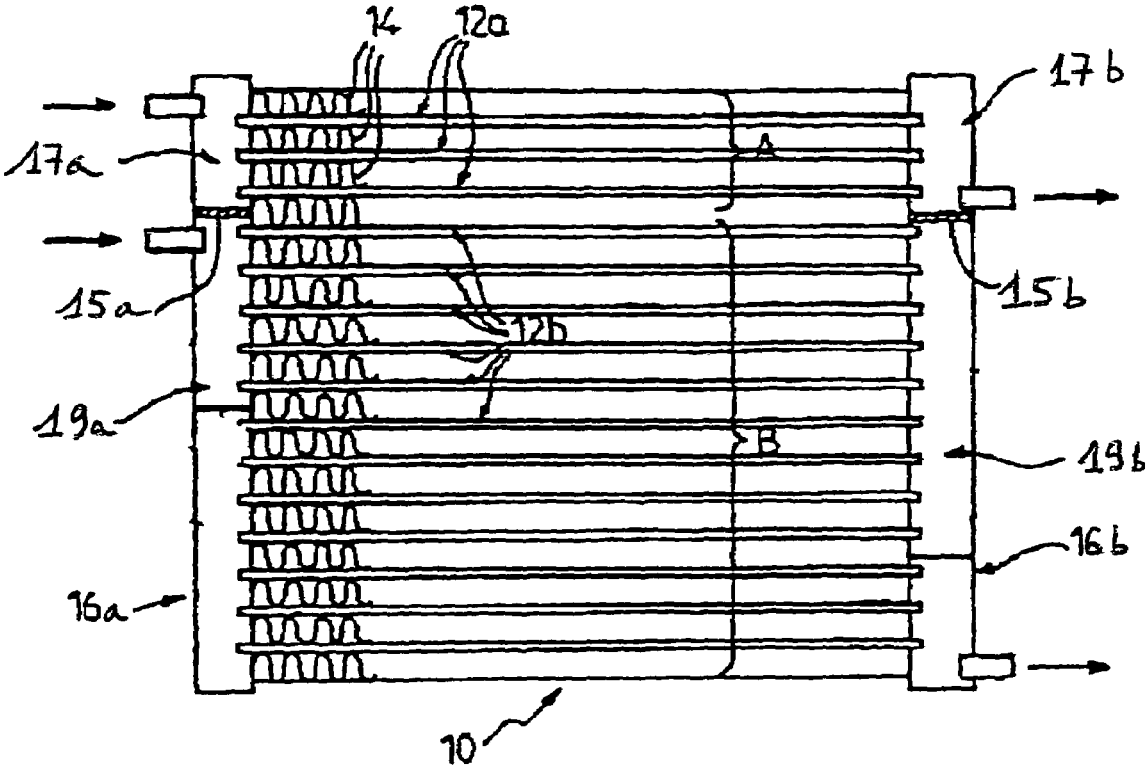
FIG. 1 is a schematic elevational view of a combo cooler as may be found in the prior art.

The prevent invention relates to the heat exchangers, and, in particular, multi-exchangers or combo cooler heat exchangers, for automotive vehicles, having a bank of spaced fluid conduits or tubes linked to manifolds, the bank divided into two parts capable of having, respectively, different fluids flowing therethrough and fins that differ in characteristics, such as average height, pitch and/or structure, preferably average height and pitch, to increase heat exchanger efficiency.

The present invention further provides for a heat exchanger assembly, and more preferably, a heat exchanger assembly comprising a multi-exchanger such as combo-cooler, with different sizes types of fins or separators, which optimizes both condenser performance, as well as oil-cooler performance. By providing for a heat exchanger assembly comprising a multi-exchanger with fins of larger fin pitch for oil-cooler fins, the thermal performance of additional heat exchangers, such as, for example, single fluid heat exchanger such as radiators, back or down flow from the air stream, overall heat exchanger performance for the vehicle is improved.

Therefore, one aspect of the present invention provides for a multi-exchanger or combo cooler heat exchanger having a first tube or tubes; a second tube or tubes; a first end tank or manifold; a second end tank or manifold opposite the first end tank or manifold; one or more first tubes in fluid communication with the first and second end tanks or 'manifolds' and adapted to have a first fluid flow therethrough; one or more second tubes in fluid communication with the first and second end tanks or 'manifolds' and adapted to have a second fluid flow therethrough; at least one first separator or fin interposed between adjacent first tubes; and at least one second separator or fin interposed between adjacent second tubes. The first separator or fin has different characteristics from the second separator or fin, in particular, different average fin sizes or fin pitches from one another. In preferred embodiments of the present invention, the air-side thermal resistance of the at least one first separator or fin, on a per separator or fin basis, is less than the air-side thermal resistance of the at least one second separator or fin. Also, in preferred embodiments, the air-wetted area of the at least one first separator or fin, on a per separator or fin basis, is less than that of the at least second separator or fin. Particularly preferred is where air-side thermal resistance and air-wetted area as described above for the first separator or fin is less than the air-side thermal resistance and air-wetted area as described above for the second separator or fin.

Providing two different types of fins, though making an assembly process slightly more complex, surprisingly reduces cost and increases profitability in the long term, due to the overall increase in thermal efficiency of the combo cooler alone, or in combination with another single or multi-exchanger. In more preferred embodiments, an at least one third separator or fin is provided. The at least one third separator or fin may be different or the same as the at least one first or second separator or fin. In the multi-exchanger wherein at least one third fin is provided, the at least one third separator or fin contacts or touches (is 'interposed') between at least one first tube and at least one second tube, and the height of the at least one third separator or fin is greater than or equal to the height of the at least one first separator or fin.

In preferred embodiments of the present invention, the multi-exchanger or combo cooler heat exchanger has at least two different fluids flowing therethrough. More preferred embodiments have the first fluid comprising a high viscosity fluid or oil and the second fluid comprising a low viscosity fluid, refrigerant or coolant.

In preferred embodiments of the present invention, the multi-exchanger or combo cooler has hydraulic diameters of the first tubes (oil cooler) greater than the hydraulic diameter of the second tubes. Also in preferred embodiments the at least one first separator or fin, on a per separator or fin basis, has an air contact area less in area than the at least one second separator or fin, on a per separator or fin basis.

In preferred embodiments comprising a low viscosity fluid and a high viscosity fluid, for example, the multi-exchanger or combo cooler, the height of the at least one second separator or fin, (for example, in a condenser) is greater than the height of the at least first separator of fin, for example, in an oil-cooler.

In preferred embodiments comprising a low viscosity fluid and a high viscosity fluid, for example, the multi-exchanger or combo cooler, the pitch of the at least one second separator or fin (for example, in a condenser) is less than the pitch of the at least one first separator or fin, for example, in an oil-cooler. In more preferred embodiments the height of the at least one second separator or fin is greater than that of the at least first separator of fin and the pitch of the at least one second separator or fin is less than the pitch of the at least one first separator or fin.

Also in preferred embodiments, a plurality of tubes, adjacent to one another, are provided, wherein the multi-exchanger or combo cooler heat exchanger comprises a first manifold and a second manifold; a plurality of adjacent tubes or a bank of tubes between the manifolds having at least one first part wherein circulates a first fluid; at least one second part of the plurality of adjacent tubes or bank of tubes between the manifolds wherein circulates a second fluid; a plurality of at least two types of heat exchanger fins interposed between adjacent tubes or conduits. In more preferred embodiments, the least one first type of fin is interposed between at least two tubes of the first part of the bank and at least one second type of fin is interposed between at least two tubes of the second part of the bank; and where within the heat exchanger the first fluid has no direct contact with the second fluid. In the more preferred embodiments, the air-side thermal resistance of the fins interposed on the first part of the bank, on a per fin basis, is less than the air-side thermal resistance of the fins interposed on the second part of the bank. Also in more preferred embodiments, the air-wetted area of the fins interposed on the first part of the bank, on a per fin basis, is less than that of the second part of the bank, even more preferably, the air side thermal resistance of the fins is less in the first part of the bank than the second and the air-wetted area of the fins is less in the first part of the bank than the second.

In preferred embodiments of the present invention, the first part of the bank or first tubes of the multi-exchanger or combo cooler have air-wetted areas less than that of the second bank or second tubes, which allows, for example, the placement of more first tubes in the same packaging (smaller overall space requirements for the same overall performance). For purposes of the present invention, wetted area can be defined as the fin depth (e.g. for a 16 mm core heat exchanger approximately 16 mm) multiplied by fin length. In such a case, the thermal resistance on the side of the first part of the bank or first tubes is high, and the additional tubes allow for an effectively increased overall heat exchange performance in that area.

In general, in accordance with an aspect of the present invention, the air-side thermal resistance of an area of exchange such as that defined by the first bank of tubes, when less than the area of exchange such as that defined by the second bank of tubes, also exhibits the characteristic that, on a per fin basis, the air-wetted area (area of exchange) of the first bank of tubes will be less than that of the second bank of tubes.

In the present invention, a 'core' comprises the area of heat exchange of the multi-exchanger or combo cooler, and, at the end of the area of heat exchange, is found the manifolds or end tanks. The core is defined as having 'parts' or areas of 'first and second tubes', wherein the depth of the core, when measured from front to back based on the normal orientation of the heat exchanger when in use, is between about 4 mm to 40 mm, and wherein the first separator or fin has different characteristics, such as fin height and pitch, from the second separator or fin.

In preferred aspects of the present invention, the height of the second separator or fin is greater than that of the first separator or fin. More preferred is when the first separator or fin has a height of between about 3 to about 12 mm. Also preferred is when the second separator or fin has a height of between about 4 to about 13 mm. More preferred is when the height of the first separator or fin is between about 3 to about 12 mm. Also more preferred is when the height is the average height of the fins per a defined area. In more preferred aspects of the present invention, the absolute value of the average difference in the heights of the second separator or fin and the first separator or fin is greater than or equal to 0.5 mm.

Also in preferred aspects of the present invention, the fin pitch, and, in particular, the average fin, pitch of the first separator(s) or fin(s) in the core differs from the fin pitch, and, in particular, the average fin pitch of the second separator(s) or fin(s). More preferably, the pitch of the first separator or fin is greater than that of the second separator or fin.

In more preferred aspects of the present invention, the average fin pitch of the first separator or fin is between about 1.0 to 3.0 mm. In other more preferred aspects of the present invention, the average fin pitch of the second separator or fin is between about 0.5 to about 2.0 mm.

Also more preferred is when the absolute value of the average difference in the pitches of the second separator or fin and the first separator or fin is greater than or equal to 0.1 mm.

In most preferred embodiments, the multi-exchanger or combo cooler heat exchanger banks, manifolds and fins are formed into an assembly by brazing.

Following conventional thinking, a heat exchanger assembly, and, particularly and oil cooler and condenser part of such an assembly, the oil-cooler tube is physically positioned higher than the condenser tube, such an architecture causing higher air-side pressure drop across the oil cooler tube than the condenser tube because it blocks more of the air-passage. What this generally means for an engine cooling system is that the performance of radiator, which is normally situated behind of back of the combo-cooler, is reduced by this higher air-side pressure drop.

As described above, the multi-exchanger or combo cooler of the present invention may form a heat exchanger assembly comprising a multi-exchanger or combo cooler described hereinabove and another heat exchanger. More preferably, the heat exchanger assembly comprises a multi-exchanger or combo cooler described hereinabove and a single fluid heat exchanger.

In preferred embodiments of the present invention, the heat exchanger assembly comprises a multi-exchanger and a single fluid heat exchanger positioned so that the multi-exchanger and single fluid heat exchanger provide for a thermal exchange affect between multi-exchanger and fluid heat exchanger. For example, when the single fluid heat exchanger is a radiator, the radiator is positioned so that it is downstream or back of the multi-exchanger. In more preferred embodiments the single fluid heat exchanger is positioned so that it is downstream or back of the multi-exchanger, and the fluid passing through the single fluid heat exchanger flows parallel with one or both of the fluids of the multi-exchanger, either following the same flow direction (concurrent) or following the opposite flow direction of the multi-exchanger flow or flows (countercurrent) with the associated air-side pressure drop within acceptable levels.

Referring to FIG. 1, a heat exchanger of the prior art is shown. A multi-exchanger such as a combo-cooler, having a condenser and an oil-cooler, may have an oil cooler part and condenser part connected with the same pair of manifolds and tubes connected to one another with fins. The combined heat exchanger represented in FIG. 1 comprises a core consisting of a multiplicity of tubes 12 extending parallel to each other and between which are arranged corrugated spacers 14 forming cooling fins. The ends of the tubes 12 open out, at one end, into a common manifold 16*a* and, at the other end, into another common manifold 16*b*.

The core is divided into two parts, namely a part A forming an oil cooler and consisting of tubes 12*a* and a part B forming a condenser and consisting of tubes 12*b*. The partition 15*a* divides the manifold 16*a* into a compartment 17*a* for the oil (here placed in the upper part) and a compartment 19*a* for the cooling fluid (here placed in the lower part). Correspondingly, the partition 15*b* divides the manifold 16*b* into a compartment 17*b* for the oil (here placed in the upper part) and a compartment 19*b* for the cooling fluid (here placed in the lower part).

Figure 2:
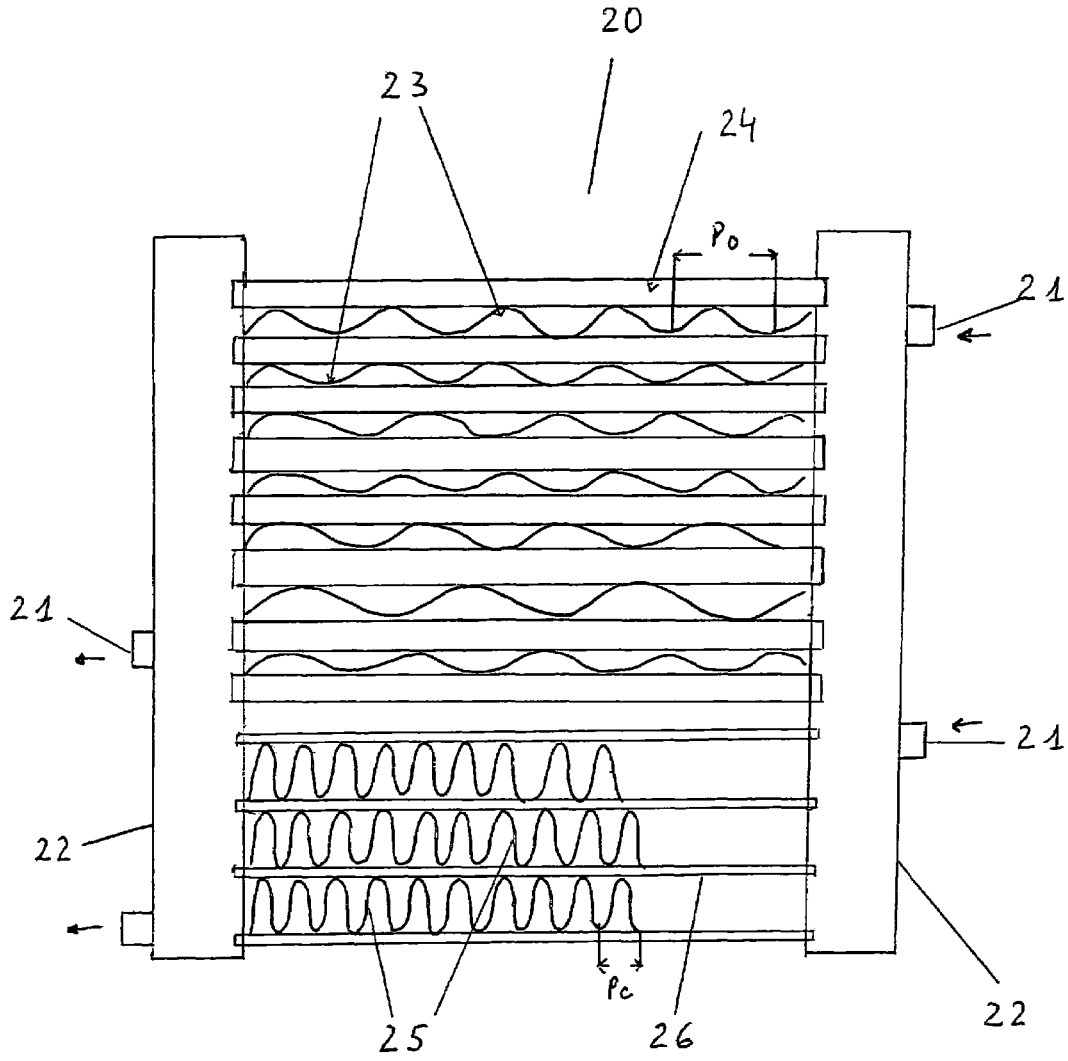
FIG. 2 is a schematic elevational view of a multi-exchanger in accordance with an aspect of the present invention.

Referring to FIG. 2, a multi-exchanger 20 is shown with two types of tubes, condenser tubes 26 and/or other tubes 24. The condenser tubes 26 and oil-cooler tubes 24 are basically parallel in arrangement, and separated by fins 23, 25. The tubes are connected with a pair of manifolds 22 at the ends of the heat exchanger. The oil-cooler fins 23 are of a lower height, than the condenser fins 25, In addition, the oil-cooler fins 23 have a pitch Po that is greater than that of the condenser fins Pc.

Figure 3:
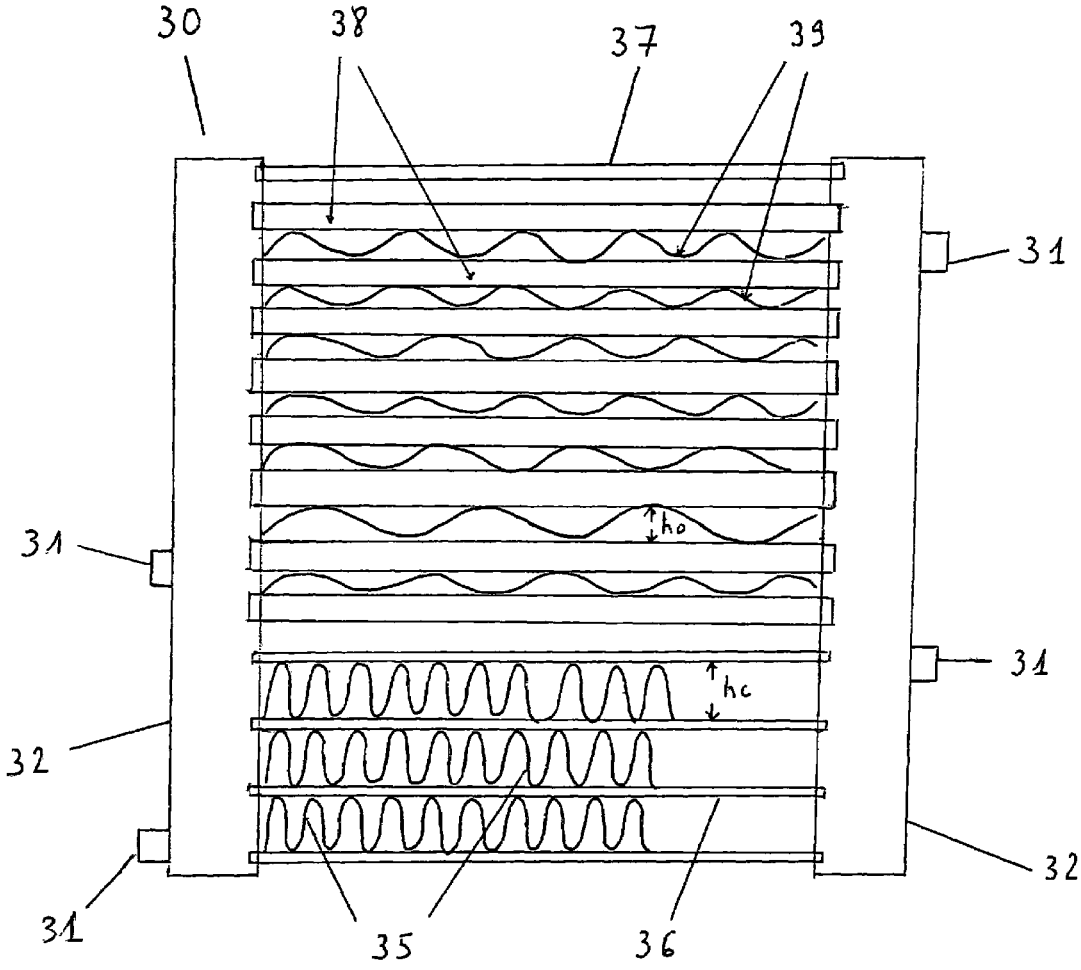
FIG. 3 is a schematic elevational view of a multi-exchanger in accordance with an aspect of the present invention.

Referring to FIG. 3, a heat exchanger 30 is shown with two types of tubes, condenser tube 36 and tube 38. The condenser tubes 36 and oil-cooler tubes 38 are basically parallel in arrangement, and separated by fins 35, 39.

The tubes are connected with a pair of manifolds 32 at the ends of the heat exchanger. The oil-cooler fins 39 are of lower height (ho) than the condenser fins 35 (hc).

FIG. 3 shows another aspect of the present invention. Because the oil cooler fins are different from condenser fins in these embodiments, (i.e. different height and/or pitch), overall thermal exchange in optimized. Though any metals capable of being brazed with conventional techniques for use in automotive heat exchanger applications may be used for the separators or fins, metals such as copper or copper alloys and aluminum or aluminum alloys preferably may be used; more preferably, aluminum or aluminum alloys are used. In preferred embodiments of the present invention, the separator or fins are made of at least one metal or alloy capable of brazing, more preferably the fins are made of the same metals or alloys capable of being brazed, more preferably the condenser or lower viscosity fluid flow-through tube fins of the multi-exchanger comprise at least one aluminum or aluminum alloy, and the oil cooler or higher viscosity fluid flow-through tube fins comprise at least one aluminum or aluminum alloy. In preferred embodiments, in particular, the oil cooler part or area has fins with fin pitches greater than condenser fin pitches, in order to reduce the air-side pressure drop of the oil-cooler part or area. A dead tube 37 is also provided.

The present invention, as shown in FIGS. 2 and 3, exemplifies that on a per-fin basis, more air-side surface to condenser fins is provided, because the air-side thermal resistance is high for the condenser and less air-side surface to oil-cooler fins is provided, due to the lower air-side thermal resistance for the oil cooler.

Figure 4:
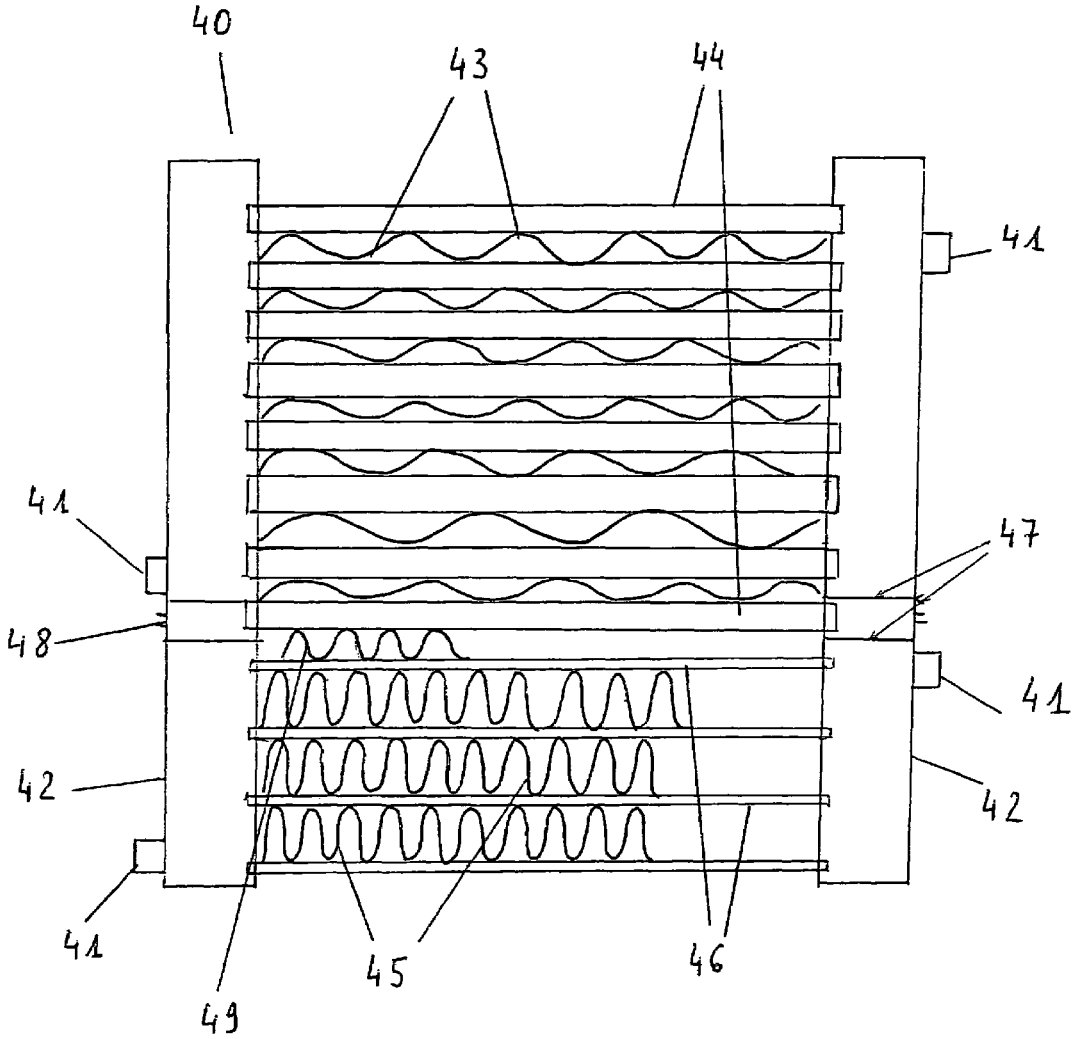
FIG. 4 is a schematic elevational view of a multi-exchanger in accordance with an aspect of the present invention.

Referring to FIG. 4, a heat exchanger has manifolds 42, weephole 48, fins 43, 45, tubes 44, 46, and inlets and outlets 41. A fin(s) 49 is located between a condenser tube(s) 46 and an oil-cooler tube(s) 44. The fin may be a condenser fin or an oil cooler fin. Preferred is a condenser fin. By employing a condenser fin, more space is provided for elements such as baffles and, in particular double baffles 47 due to the condenser fins comparatively higher height versus an oil cooler fin.

Figure 5:
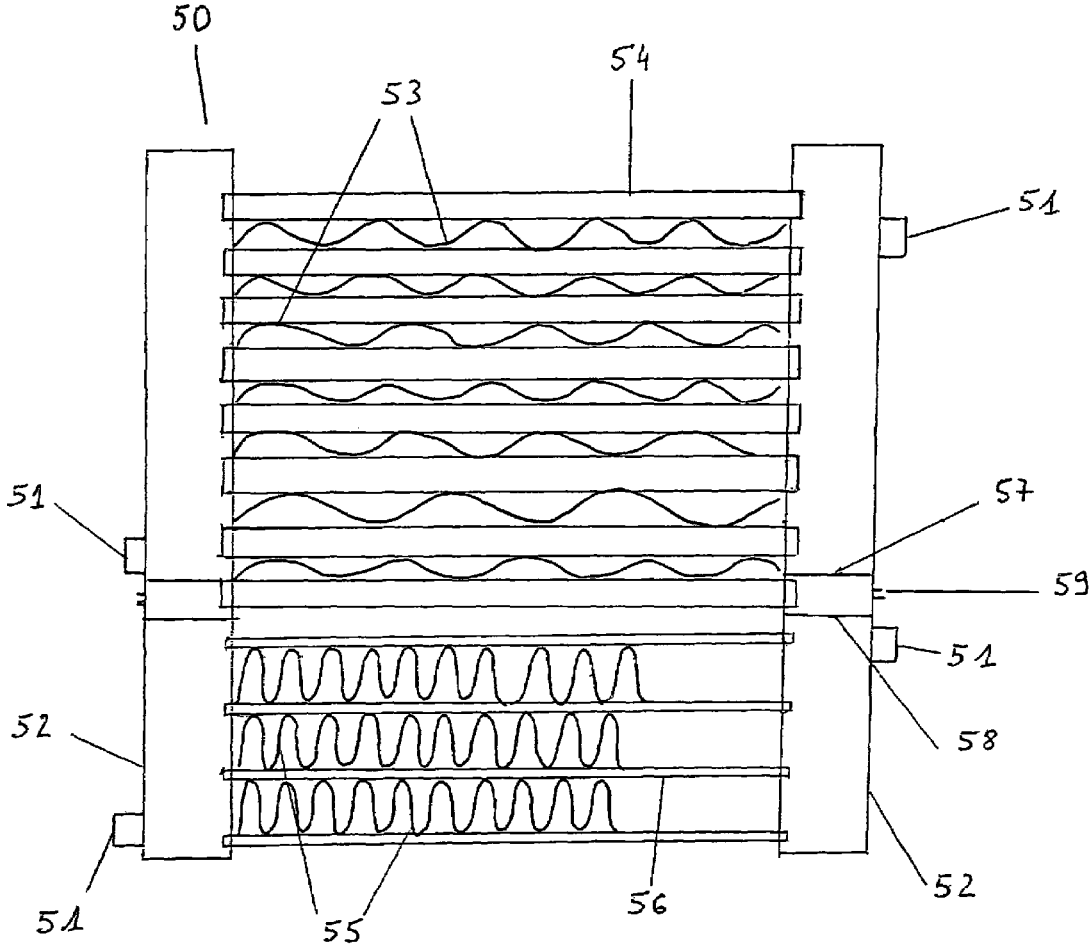
FIG. 5 is a schematic elevational view of a multi-exchanger in accordance with an aspect of the present invention.

Referring to FIG. 5, a multi-exchanger 50 is present comprising manifolds 52, inlets and outlets 51, high viscosity fluid flow through tubes 54, low viscosity fluid flow through tubes 56, first fins 53, and second fins 55, with manifolds weephole 59. Baffles of a double baffle 57, 58, are provided.

Figure 6:
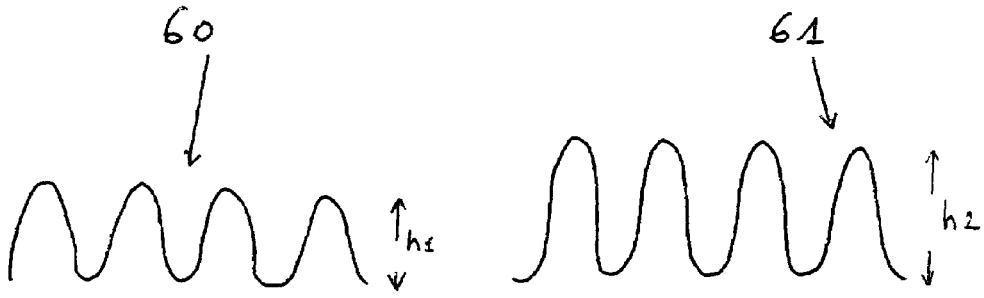
FIG. 6 is a schematic elevational view of a multi-exchanger in accordance with an aspect of the present invention.
Figure 7:
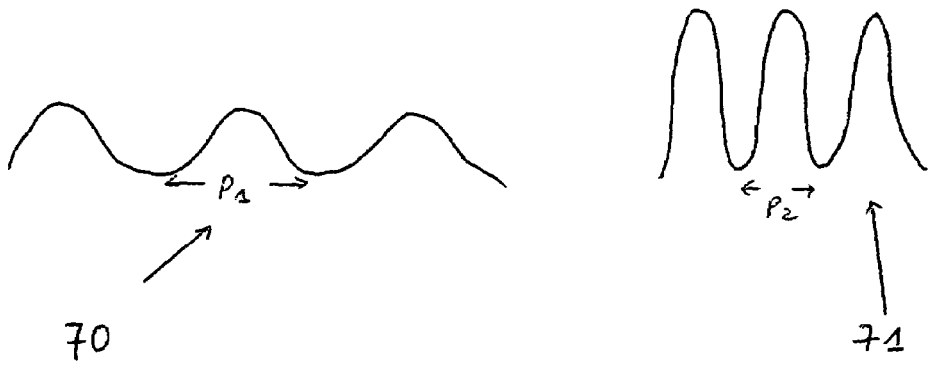
FIG. 7 is schematic view of fins employed in multi-exchangers in accordance with aspects of the present invention.

Referring to FIGS. 6 and 7, fin(s) or separator(s) 60, 61, 70, 71 of the type that may be used in the present invention are shown. The fins shown here have, as essential features or 'characteristics', a height h1 and pitch h2, more particularly, an average height and pitch, which may differ based on whether they are on the first or second bank or interposed between first and second tubes, of the multi-exchanger or condenser. Fins with height h, 60 and pitch P, 70 are interposable between the first tubes. Fins with height h2 61 and P2 71 are interposable between the second tubes. The average height of the fins h2 is inferior to the average height of the fins h2 in the core.

Figure 8:
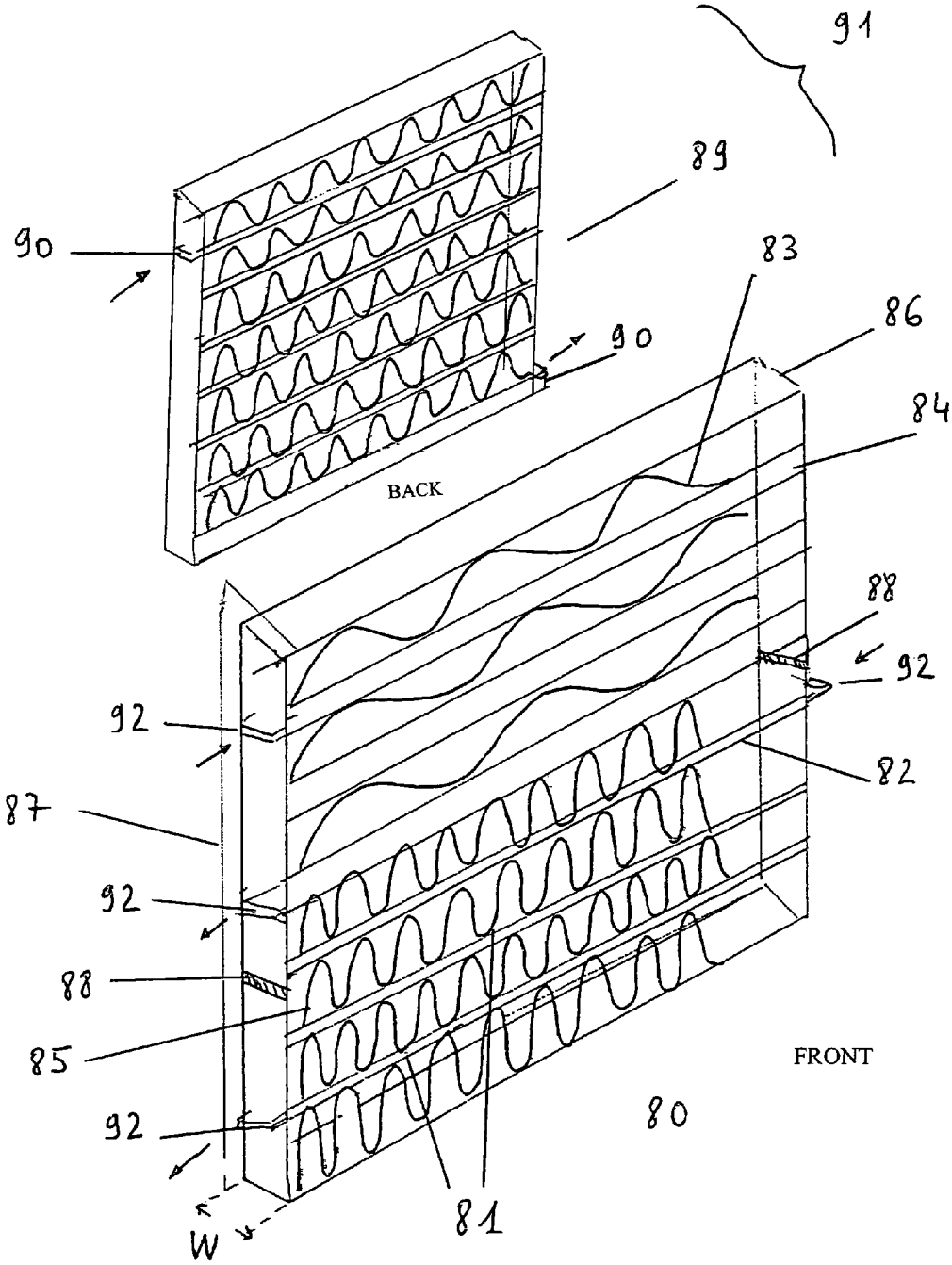
FIG. 8 is a stylized perspective view of a multi-exchanger and assembly in accordance with an aspect of the present invention.

Referring to FIG. 8, a multi-exchanger assembly 91 comprising a multi cooler 80 and a single fluid exchanger (radiator) 89 is shown. The multi exchanger 80, has tubes 84, 82, fins 83, 81, manifolds 86, 87, inlets, outlets 90, and baffles 88. Back, or downstream the multi-exchanger 80 is a single fluid exchanger 89, that is placed in close proximity to the multi exchanger so that a combined heat exchanger effect can take place, with inlet and outlet 90.

The size of the fin and its composition may differ based on the hydraulic diameter of the tubes. In multi-exchangers having tubes, where a first part has tubes wherein the fluid flowing therethrough comprises a high viscosity fluid, oil or similarly viscous fluid, and a second part has tubes wherein the fluid flowing therethrough comprises a low viscosity fluid, refrigerant or coolant, or similarly viscous fluid, the high viscosity fluid or oil-cooler part of the heat exchanger preferably has tubes with a hydraulic diameter greater than the hydraulic diameter of the tubes of the low viscosity fluid or condenser part. It is also preferred that the tubes of the heat exchangers of the present invention have a number of passageways, ports or channels therein. In combo coolers having an oil cooler part and a condenser part, it is particularly preferred that the number of passageways or channels of the tubes of the oil-cooler part be fewer in number than the number of channels of the tubes of the condenser part. In other words, the tubes of the oil-cooler part contain fewer 'partitions' than the tubes of the condenser part.

In preferred aspects of the present invention, a mean for detecting 'leaks' or previously un-detected fluid mixture, between, for example, oil and refrigerant fluids in the manifold, is provided. A preferred means for detecting said 'leaks' or undesired 'mixtures' is by using a detecting hole or 'weep-hole' along with a baffle, or, preferably a double baffle inside the manifold to keep the different fluids separate.

According to another aspect of the present invention, the tubes of the bank are linked to two manifolds each of which includes a separating partition or baffle for isolating the first fluid circulating in the first part of the multi-exchanger or combo cooler, from the second fluid circulating in the second part of the multi-exchanger or combo cooler. In more preferred embodiments, where the first fluid is an oil and the second fluid is a refrigerant or coolant, the baffle isolates the oil circulating in the oil-cooler part from the cooling fluid circulating in the condenser part. Even more preferred are manifolds comprising at least two baffles or one double baffle. In more preferred embodiments having a double baffle, it is even more preferred to have a 'weep hole' or other similar contact with the exterior of the manifold at a point near the baffle, as a detection means for identifying undesirable mixing of the two fluids separated from one another in the manifold by the baffle.

In more preferred embodiments of the present invention, at least one tube of the bank is constructed so that fluid is restricted from flowing therein forming a so called "inactive tube" or "dead tube". In even more preferred embodiments of the present invention, the bank, fins and the manifolds are assembled by brazing.

Hence, the multi-exchanger or combo cooler heat exchanger of the present invention can be produced according to well-known technologies of brazing used for the construction, for example, of brazed heat exchangers. Also in most preferred embodiments the tubes of the bank are made with extrusion techniques or by extrusion.

The present invention may be used in a wide range of applications. The present invention in preferred embodiments, may comprise not only oil cooler/condenser combination but may be applicable to all multi exchangers that comprise different fluids for maximum effect, for example, a condenser is an example of one type of cooler or exchanger, the radiator an another type of cooler or exchanger. The air-side thermal resistance measured in percentage of each cooler or exchanger is different particularly in a combo-cooler or multi heat exchanger comprising two or more air-cooled exchanger elements, in which each exchanger has fins.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skills in the art would realize, however, that certain modifications will come within the teachings of this invention. Therefore, the following claims should be studied to determine the true scope and content of the invention.

What is claimed is:

1. A combo cooler heat exchanger, comprising:

a plurality of first tubes;

a plurality of second tubes;

a first end tank;

a second end tank opposite the first end tank; and the plurality of first tubes in fluid communication with the first and second end tanks and adapted to have a first fluid flow therethrough;

the plurality of second tubes in fluid communication with the first and second end tanks and adapted to have a fluid flow therethrough;

at least one first tube of the plurality of first tubes adjacent to another first tube;

at least one second tube of the plurality of second tubes adjacent to another second tube;

at least one first fin interposed between adjacent first tubes; and at least one second fin interposed between adjacent second tubes;

wherein the plurality of first tubes and the plurality of second tubes are basically parallel to one another and are connected with the same pair of tanks, and the first fin has different characteristics from the second fin, wherein the hydraulic diameter of the first tubes is greater than the hydraulic diameter of the second tubes and wherein the at least one first fin, on a per fin basis, has an air contact area less in area than the at least one second fin, on a per fin basis and wherein the height of the at least one second fin is greater than that of the at least first fin and wherein the pitch of the at least one second fin is less than the pitch of the at least one first fin.

2. A combo cooler heat exchanger, comprising:

a plurality of first tubes;

a plurality of second tubes;

a first end tank;

a second end tank opposite the first end tank;

a core comprising the first and second tubes and first and second end tanks;

the plurality of first tubes and the plurality of second tubes in the core are connected to and in fluid communication with the first and second end tanks;

the plurality of first tubes are adapted to have a fluid flow of a first fluid therethrough;

the plurality of second tubes are adapted to have a fluid flow of a second fluid therethrough;

at least one first fin is interposed between and connected to adjacent first tubes, the at least one first fin having a height between about 3 to about 12 mm; and at least one second fin is interposed between and connected to adjacent second tubes;

wherein the depth of the core when measured from front to back is between about 4 mm to 40 mm, and wherein the first fin has different characteristics from the second fin;

wherein the plurality of first tubes and the plurality of second tubes are coplanar;

wherein the first fluid and the second fluid are distinguishably different fluids;

and wherein the hydraulic diameter of the first tubes is greater than the hydraulic diameter of the second tubes and wherein the at least one first fin, on a per fin basis, has an air contact area less in area than the at least one second fin, on a per fin basis and wherein the height of the second fin is greater than that of the first fin.

3. The combo cooler heat exchanger of claim 2, wherein the height of the first fin is between about 3 to about 12 mm.

4. The combo cooler heat exchanger of claim 2, wherein the absolute value of the average difference in the heights of the second fin and the first fin is greater than or equal to 0.5 mm.

5. A combo cooler heat exchanger, comprising: a plurality of first tubes;

a plurality of second tubes different from the plurality of first tubes;

a first end tank;

a second end tank opposite the first end tank;

the plurality of first tubes connected with and in fluid communication with the first and second end tanks and adapted to have a fluid flow of a first fluid therethrough;

the plurality of second tubes connected with and in fluid communication with the first and second end tanks and adapted to have a fluid flow of a second fluid therethrough;

at least one first separator interposed between adjacent first tubes; and at least one second separator interposed between adjacent second tubes;

wherein the first separator has different characteristics from the second separator, and wherein the hydraulic diameter of the first tubes is greater than the hydraulic diameter of the second tubes and wherein the at least one first separator, on a per separator basis, has an air contact area less in area than the at least one second separator, on a per separator basis, and wherein the height of the at least one second separator is greater than that of the at least first separator and wherein the pitch of the at least one second separator is less than the pitch of the at least one first separator;

wherein the plurality of first tubes and the plurality of second tubes are coplanar;

and wherein the first fluid and the second fluid are distinguishably different fluids.

6. A combo cooler heat exchanger, comprising:

a plurality of first tubes;

a plurality of second tubes;

a first end tank;

a second end tank opposite the first end tank;

the one or more first tubes in fluid communication with the first and second end tanks and adapted to have a first fluid flow therethrough;

the one or more second tubes in fluid communication with the first and second end tanks and adapted to have a fluid flow therethrough;

at least one first separator interposed between adjacent first tubes; and at least one second separator interposed between adjacent second tubes;

wherein the first separator has different characteristics from the second separator, the hydraulic diameter of the first tubes is greater than the hydraulic diameter of the second tubes, the at least one first separator, on a per separator basis, has an air contact area less in area than the at least one second separator, on a per separator basis, the height of the at least one second separator is greater than that of the at least first separator, and wherein the pitch of the at least one second separator is less than the pitch of the at least one first separator.

7. A combo cooler heat exchanger, comprising:

a plurality of first tubes;

a plurality of second tubes;

a first end tank;

a second end tank opposite the first end tank;

one or more first tubes in fluid communication with the first and second end tanks and adapted to have a first fluid flow therethrough;

one or more second tubes in fluid communication with the first and second end tanks and adapted to have a fluid flow therethrough;

at least one first fin interposed between adjacent first tubes; and at least one second fin interposed between adjacent second tubes;

wherein the first fin has different characteristics from the second fin, and wherein the pitch of the at least one second fin is less than the pitch of the at least one first fin, the hydraulic diameter of the first tubes is greater than the hydraulic diameter of the second tubes, the at least one first fin, on a per fin basis, has an air contact area less in area than the at least one second fin, on a per fin basis, and wherein the height of the at least one second fin is greater than that of the at least first fin.

8. A combo cooler as in claim 5, wherein the air-side thermal resistance of the at least one first separator, on a per separator basis, is less than the air-side thermal resistance of the at least one second separator.

9. The combo cooler heat exchanger of claim 5, wherein the second tubes are adapted to have a second fluid flow therethrough and wherein the first fluid comprises a high viscosity fluid or oil and the second fluid comprises a low viscosity fluid, refrigerant or coolant.

* * * * *